US007377516B2

(12) United States Patent
Vallee et al.

(10) Patent No.: US 7,377,516 B2
(45) Date of Patent: May 27, 2008

(54) BALL TOSSING GAME

(76) Inventors: Jean Paul Vallee, 4980 S. Alma School Rd., Suite A2#121, Chandler, AZ (US) 85248; Misty M. Vallee, 4980 S. Alma School Rd., Suite A2#121, Chandler, AZ (US) 85248; Nicole R. Kosier, 325 Morning Star Cir., China Spring, TX (US) 76633; Danielle R. Jones, 808 S. Ridgeway St., Payson, AZ (US) 85541

( * ) Notice: Subject to any disclaimer, the term of this patent is extended or adjusted under 35 U.S.C. 154(b) by 0 days.

(21) Appl. No.: 11/550,521

(22) Filed: Oct. 18, 2006

(65) Prior Publication Data

US 2008/0093803 A1 Apr. 24, 2008

(51) Int. Cl.
*A63B 63/00* (2006.01)

(52) U.S. Cl. ..... 273/343

(58) Field of Classification Search ..... 273/343, 273/348, 331, 336

See application file for complete search history.

(56) References Cited

U.S. PATENT DOCUMENTS 6,308,956 B1 * 10/2001 Reid ..... 273/343
6,773,014 B2 * 8/2004 Lynch ..... 273/343
6,808,175 B1 * 10/2004 Gleeson ..... 273/343
7,004,468 B2 * 2/2006 Johnson et al. ..... 273/343
7,134,661 B2 * 11/2006 Trecartin ..... 273/343
2002/0084588 A1 * 7/2002 Lynch ..... 273/343
2005/0077682 A1 * 4/2005 Trecartin ..... 273/343
2005/0082761 A1 * 4/2005 Lynch ..... 273/343
2005/0134000 A1 * 6/2005 Johnson et al. ..... 273/343
2005/0269784 A1 * 12/2005 Peters ..... 273/343
2007/0035093 A1 * 2/2007 Fuchs ..... 273/343

* cited by examiner

*Primary Examiner*—Raleigh W. Chiu
(74) *Attorney, Agent, or Firm*—Craig Weiss; Veronica-Adele R. Cao; Weiss & Moy, P.C.

(57) ABSTRACT

A ball tossing game consists of a tossing device that is thrown at a target device. The tossing device may consist of a string or other flexible connector, having a ball on each end thereof. The target has at least one and preferably multiple horizontally-oriented rungs, onto which the tossing device may be wrapped. Additional targets are provided, including a target defined by a vertically oriented post positioned proximate an end of a horizontal rung and perpendicular thereto. In another embodiment, a reduced-length horizontal rung is coupled to at least one of the rungs, and is oriented either above or below the rung. It may be desired to provide, for a single rung, vertically oriented posts and at least one reduced-length horizontal rung.

14 Claims, 2 Drawing Sheets

BALL TOSSING GAME

FIELD OF THE INVENTION

The present invention relates generally to ball tossing games and, more particularly, to an improved ball tossing game in which a participant tosses a pair of balls joined by a string (or the like) at a plurality of targets, onto which the pair of balls may become wrapped.

BACKGROUND OF THE INVENTION

Tossing games of various kinds are known in the art. One particular game, known as "Top Toss," involves participants throwing a pair of balls, joined by a string, at a multi-rung target. Players win by achieving more string wraps onto a rung than an opponent.

There are several limitations associated with "Top Toss." Prominent among these is the failure of the game to provide multiple target opportunities. Instead, the sole target opportunity presented is that of a rung. Additional target opportunities would increase the excitement of the game, by creating additional ways of scoring points and rewarding tossing accuracy.

The present invention satisfies these needs and provides other, related, advantages.

SUMMARY OF THE INVENTION

In accordance with an embodiment of the present invention, a ball tossing game apparatus is disclosed. The apparatus comprises, in combination: a tossing device; and a multi-rung target capable of having the tossing device wrapped therearound; wherein the multi-rung target comprises: a plurality of horizontally disposed rungs coupled at each end thereof to a vertical leg; and at least one vertically projecting post disposed perpendicularly to at least one of the plurality of horizontally disposed rungs and defining a horizontal wrapping area between the vertically projecting post and one of the vertical legs.

In accordance with another embodiment of the present invention, a ball tossing game apparatus is disclosed. The apparatus comprises, in combination: a tossing device; and a multi-rung target capable of having the tossing device wrapped therearound; wherein the multi-rung target comprises: a plurality of horizontally disposed rungs coupled at each end thereof to a vertical leg; and a reduced-length horizontal rung coupled to at least one of the plurality of horizontally disposed-rungs remote from the vertical legs and defining a parallel horizontal wrapping area.

In accordance with a further embodiment of the present invention, a ball tossing game apparatus is disclosed. The apparatus comprises, in combination: a tossing device; and a multi-rung target capable of having the tossing device wrapped therearound; wherein the multi-rung target comprises: a plurality of horizontally disposed rungs coupled at each end thereof to a vertical leg; at least one vertically projecting post disposed perpendicularly to at least one of the plurality of horizontally disposed rungs and defining a horizontal wrapping area between the vertically projecting post and one of the vertical legs; and a reduced-length horizontal rung coupled to at least one of the plurality of horizontally disposed-rungs remote from the vertical legs and defining a parallel horizontal wrapping area.

DETAILED DESCRIPTION OF THE PREFERRED EMBODIMENTS

Figure 1:
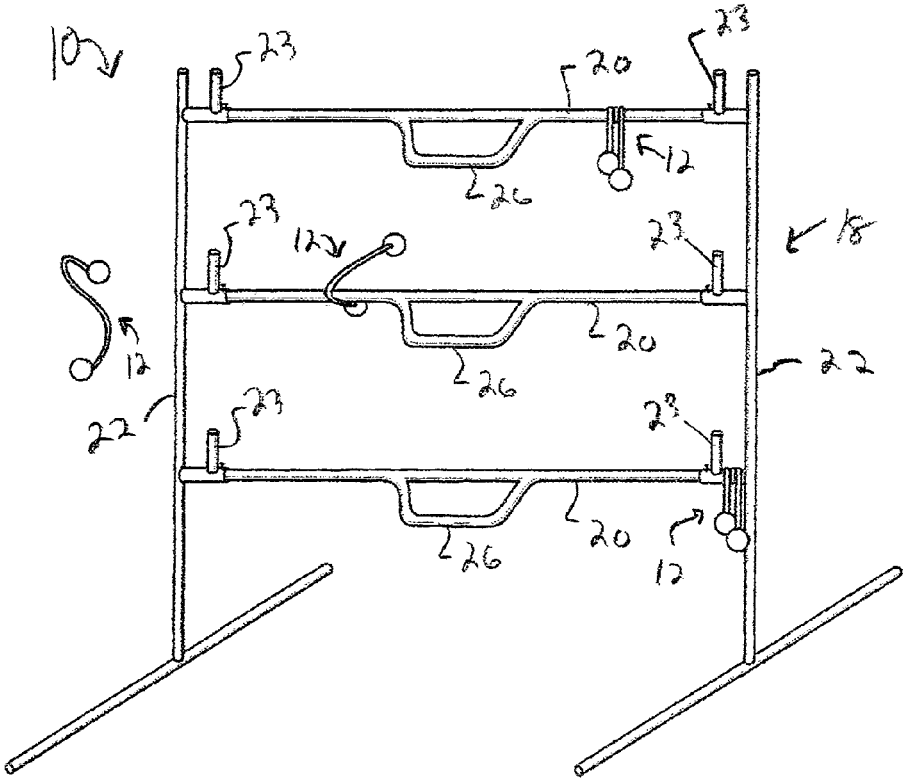
FIG. 1 is a perspective view of a ball tossing game apparatus consistent with an embodiment of the present invention.
Figure 3:
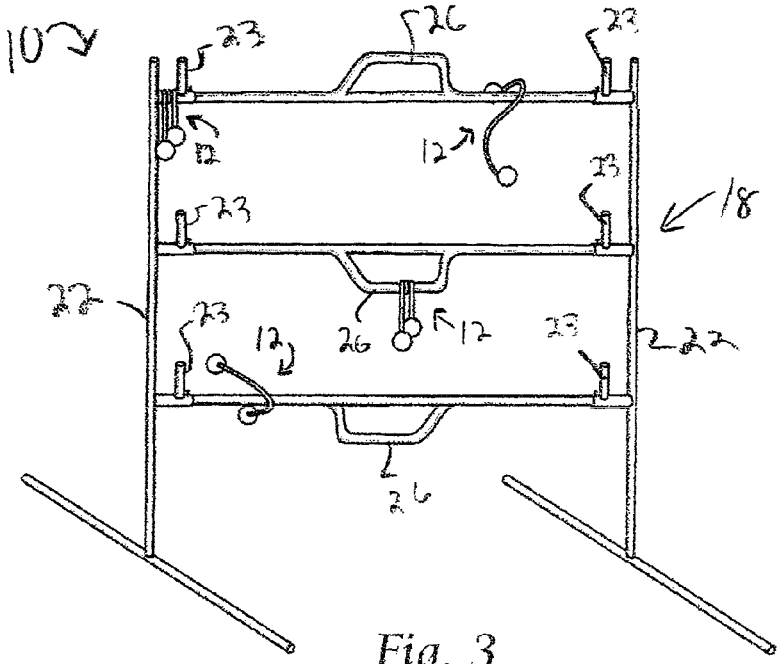
FIG. 3 is a perspective view of a ball tossing game apparatus consistent with still another embodiment of the present invention.
Figure 4:
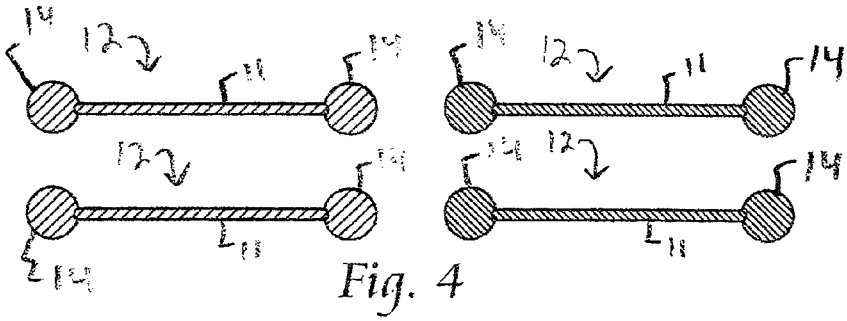
FIG. 4 is a side, cross-sectional view of pairs of balls that may be utilized as part of a ball tossing game apparatus consistent with an embodiment of the present invention.

Referring initially to FIGS. 1, 3 and 4, there are two primary components of a ball tossing game apparatus 10 consistent with the present invention. These are a tossing device 12, which preferably consists of a string or other flexible connector 11 having a ball 14 at each end thereof, and a target 18. As hereinafter described, play of the game of the present invention involves the tossing of the tossing device 12 at the target 18.

Referring more specifically to FIG. 1, an embodiment of the target 18 is shown and described. In this embodiment, the target 18 comprises three horizontal rungs 20, interposed between and coupled at each end thereof to vertical legs 22. It should be noted that three rungs 20 is exemplary—it may be desired to provide a greater or lesser number of rungs 20.

Preferably, perpendicular to at least one of the rungs 20, at least one vertically projecting post 23 is disposed. As shown in FIG. 1, it is preferred to dispose two posts 23 perpendicular to each rung 20, with each post 23 being proximate one of the vertical legs 24. The positioning of a projecting post 23 proximate a vertical leg 22 defines a horizontal target between the projecting post 23 and the most proximate vertical leg 22. It can be seen in FIG. 1 that, with respect to the bottom-most rung 20, a tossing device 12 has been successfully wrapped around such a horizontal target area.

While it is preferred to upwardly orient the projecting posts 23, it should be noted that it may be desired to downwardly orient them. Whether in an upward or a downward orientation, a projecting post 23 would be considered to be "vertically projecting" as that term is used herein.

Still referring to FIG. 1, in one embodiment, at least one reduced-length horizontal rung 26 is coupled to a rung 20, parallel to the rung 20. In one embodiment, each rung 20 has a reduced-length horizontal rung 26 coupled thereto. The rung 26 may be positioned below its corresponding rung 20, as shown in FIG. 1, or above, as shown with respect to the topmost rung 20 in FIG. 3. The rung 26 may be coupled proximate a middle portion of its corresponding rung 20, as shown by way of example in FIG. 1, or at another location(s) along rung 20. It may also be desired to provide more than one rung 26 along a single rung 20.

Figure 2:
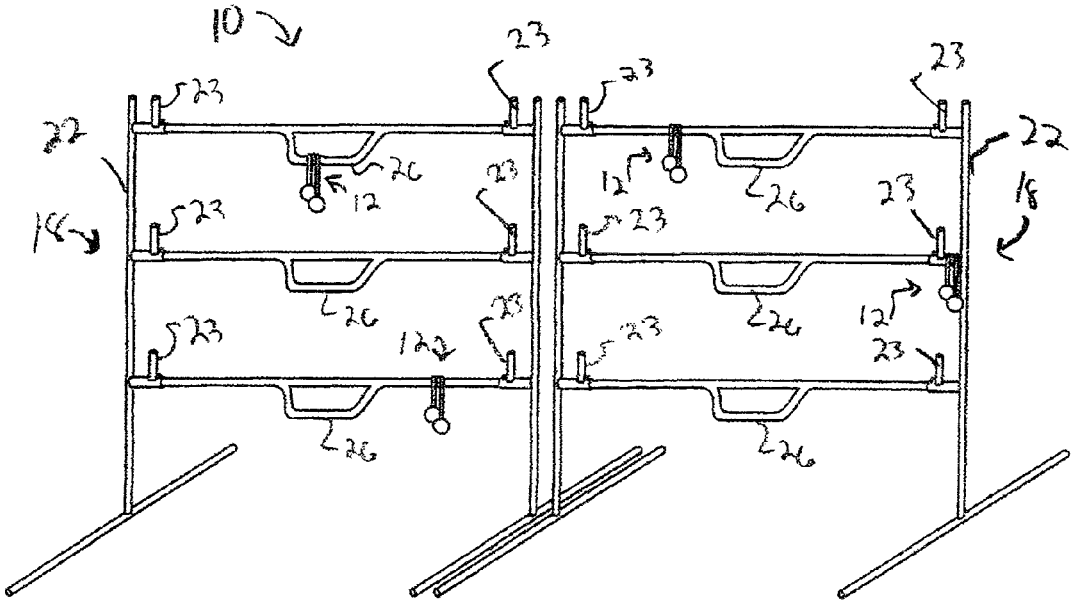
FIG. 2 is a perspective view of a ball tossing game apparatus consistent with another embodiment of the present invention.

The rung 26 defines an additional target wrapping area for the tossing device 12. FIGS. 2 and 3 illustrate a tossing device 12 having been successfully wrapped around a rung 26.

As shown in FIGS. 1 and 3, a ball tossing game consistent with the present invention may be played with a single target 18. Alternatively, it may be desired to utilize a plurality of targets 18, with the example of two targets 18 being shown in FIG. 2.

Referring specifically to FIG. 4, it is desired to provide a plurality of tossing devices 12. Preferably, as indicated by the cross-hatching, at least a first group is provided having a first colored appearance and a second group is provided having a second colored appearance. In this fashion, players can continue to track which player's tossing device 12 has successfully wrapped around some portion of the target device 18.

Figure 5:
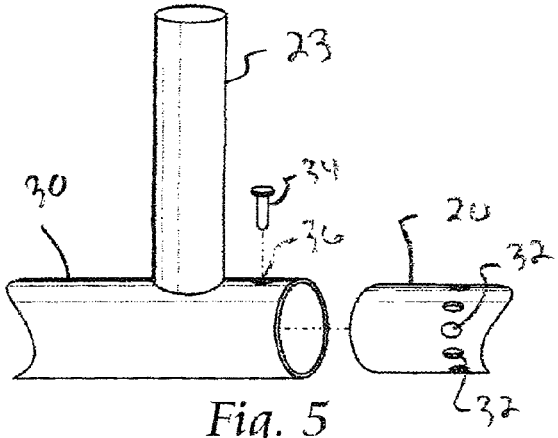
FIG. 5 is a partial, front, exploded view of a target portion of a ball tossing game apparatus consistent with an embodiment of the present invention, illustrating coupling between a vertical leg and a horizontal rung.
Figure 6:
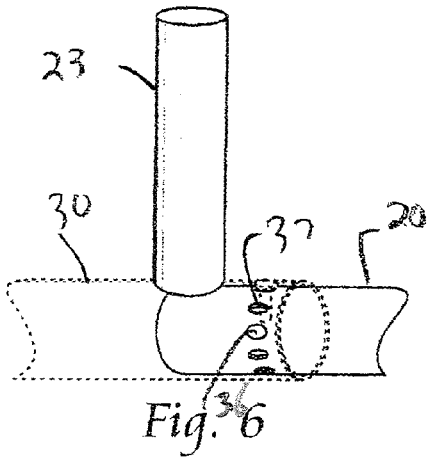
FIG. 6 is a partial front view of a target portion of a ball tossing game apparatus consistent with an embodiment of the present invention, illustrating coupling between a vertical leg and a horizontal rung.

With respect to the construction of the target 18, in one embodiment, each vertical leg 22 has a number of sleeves 30 extending therefrom, corresponding to the number of rungs 20 that may be utilized. Referring now to FIGS. 5-6, the target 18 may be assembled by insertion of each end of a rung 20 into a sleeve 30. Referring to FIG. 5, the rung 20 may be provided with a plurality of openings 32 therein, with the securing of the rung 20 to the sleeve 30 being accomplished by insertion of a pin 34 into an opening 36 in the sleeve 30 and than through the most proximate opening 32 in the rung 20. Referring now to FIG. 6, alternatively, the rung 20 may be provided with at least one ball detent 37, with the securing of the rung 20 to the sleeve 30 being accomplished by the inserting of the at least one ball detent 37 through at least one opening 36 in the sleeve 30. In one embodiment, a post 23 is coupled to each sleeve 30.

While the invention has been particularly shown and described with reference to preferred embodiments thereof, it will be understood by those skilled in the art that the foregoing and other changes in form and details may be made therein without departing from the spirit and scope of the invention.

We claim:

1. A ball tossing game apparatus comprising, in combination:

a tossing device; and a multi-rung target capable of having the tossing device wrapped therearound;

wherein the multi-rung target comprises:

a plurality of horizontally disposed rungs coupled at each end thereof to a vertical leg; and at least one vertically projecting post disposed perpendicularly to at least one of the plurality of horizontally disposed rungs and defining a horizontal wrapping area between the vertically projecting post and one of the vertical legs.

2. The apparatus of claim 1 further comprising two vertically projecting posts disposed perpendicularly to at least one of the plurality of horizontally disposed rungs and defining horizontal wrapping areas between each of the vertically projecting posts and the vertical leg most proximate thereto.

3. The apparatus of claim 2 wherein the multi-rung target comprises three rungs.

4. The apparatus of claim 3 wherein each of the three rungs has two vertically projecting posts located thereon.

5. A ball tossing game apparatus comprising, in combination:

a tossing device; and a multi-rung target capable of having the tossing device wrapped therearound;

wherein the multi-rung target comprises:

a plurality of horizontally disposed rungs coupled at each end thereof to a vertical leg;

at least one vertically projecting post disposed perpendicularly to at least one of the plurality of horizontally disposed rungs and defining a horizontal wrapping area between the vertically projecting post and one of the vertical legs; and a reduced-length horizontal rung coupled to at least one of the plurality of horizontally disposed-rungs remote from the vertical legs and defining a parallel horizontal wrapping area.

6. The apparatus of claim 5 further comprising two vertically projecting posts disposed perpendicularly to at least one of the plurality of horizontally disposed rungs and defining horizontal wrapping areas between each of the vertically projecting posts and the vertical leg most proximate thereto.

7. The apparatus of claim 6 wherein the multi-rung target comprises three rungs.

8. The apparatus of claim 7 wherein each of the three rungs has two vertically projecting posts located thereon.

9. The apparatus of claim 5 wherein the reduced-length horizontal rung is positioned below the horizontally disposed rung.

10. The apparatus of claim 5 wherein the reduced-length horizontal rung is positioned above the horizontally disposed rung.

11. The apparatus of claim 5 wherein the reduced-length horizontal run is positioned proximate a center portion of the horizontally disposed rung.

12. The apparatus of claim 5 wherein the reduced-length horizontal rung is interposed between the two vertically projecting posts.

13. The apparatus of claim 12 wherein the vertically projecting posts project in an upward direction above the horizontally disposed rung, and the reduced-length horizontal rung is positioned below the horizontally disposed rung.

14. The apparatus of claim 12 wherein the vertically projecting posts project in an upward direction above the horizontally disposed rung, and the reduced-length horizontal rung is positioned above the horizontally disposed rung.

* * * * *